US012735865B2

(12) United States Patent
Ainapure et al.

(10) Patent No.: US 12,735,865 B2
(45) Date of Patent: Sep. 15, 2026

(54) COLLISION AVOIDANCE SYSTEM FOR AVOIDING COLLISION BETWEEN DIG COMPONENTS AND BLADE ON AN EXCAVATOR

(71) Applicant: Deere & Company, Moline, IL (US)

(72) Inventors: Piyush Ainapure, Pune (IN); Amol Phadtare, Pune (IN); Lance R. Sherlock, Asbury, IA (US)

(73) Assignee: Deere & Company, Moline, IL (US)

( * ) Notice: Subject to any disclaimer, the term of this patent is extended or adjusted under 35 U.S.C. 154(b) by 445 days.

(21) Appl. No.: 18/364,219

(22) Filed: Aug. 2, 2023

(65) Prior Publication Data

US 2025/0043541 A1 Feb. 6, 2025

(51) Int. Cl.

| | |
|---|---|
| ***E02F 3/43*** | (2006.01) |
| ***E02F 9/20*** | (2006.01) |
| ***E02F 9/26*** | (2006.01) |

(52) U.S. Cl.

CPC ..... *E02F 9/2033* (2013.01); *E02F 3/43* (2013.01); *E02F 9/265* (2013.01)

(58) Field of Classification Search

None

See application file for complete search history.

(56) References Cited

U.S. PATENT DOCUMENTS

| | | | | |
|---|---|---|---|---|
| 5,957,989 | A | 9/1999 | Egawa et al. | |
| 6,064,918 | A | 5/2000 | Ohtsukasa et al. | |
| 10,801,180 | B2 | 10/2020 | Sherlock | |
| 2004/0237353 | A1* | 12/2004 | Okunishi | E02F 9/085 37/403 |
| 2010/0170118 | A1* | 7/2010 | Thomas | E02F 9/2275 37/305 |
| 2019/0249391 | A1* | 8/2019 | Kikuchi | E02F 3/845 |
| 2019/0330823 | A1 | 10/2019 | Kean | |
| 2019/0376260 | A1* | 12/2019 | Sherlock | E02F 3/435 |
| 2020/0024829 | A1* | 1/2020 | Fiser | E02F 3/964 |
| 2020/0232180 | A1* | 7/2020 | Takebayashi | E02F 3/437 |
| 2020/0340206 | A1* | 10/2020 | Mori | E02F 9/2267 |
| 2021/0207339 | A1* | 7/2021 | Nakatani | E02F 3/845 |
| 2021/0332560 | A1* | 10/2021 | Takebayashi | E02F 9/2296 |
| 2022/0298744 | A1* | 9/2022 | Horii | E02F 3/325 |

(Continued)

FOREIGN PATENT DOCUMENTS

| | | |
|---|---|---|
| CN | 104420494 B | 5/2018 |
| DE | 69612271 T2 | 7/2001 |

(Continued)

OTHER PUBLICATIONS

German Search Report issued in application No. 102024118692.5 dated Feb. 17, 2025, 12 pages.

(Continued)

*Primary Examiner* — James M McPherson

(74) *Attorney, Agent, or Firm* — Christopher J. Volkmann; KELLY, HOLT & CHRISTENSON PLLC

(57) ABSTRACT

An excavator has a lower frame with a blade movably mounted to the lower frame. The excavator also has dig components such as a boom, an arm, and an attachment. The positions of the dig components are identified and a control signal generator controls movement of the dig component to avoid a collision between the boom or attachment and the blade.

20 Claims, 12 Drawing Sheets

(56) References Cited

U.S. PATENT DOCUMENTS

| | | | | |
|---|---|---|---|---|
| 2023/0084302 | A1* | 3/2023 | Okazaki | E02F 3/437<br>37/403 |
| 2023/0407601 | A1* | 12/2023 | Lee | E02F 3/435 |
| 2024/0093463 | A1* | 3/2024 | Sakisaka | E02F 3/325 |
| 2025/0026622 | A1 | 1/2025 | Iotti | |

FOREIGN PATENT DOCUMENTS

| | | | |
|---|---|---|---|
| DE | 69831713 | T2 | 5/2006 |
| DE | 102019206515 | A1 | 12/2019 |
| EP | 3409841 | A1 | 12/2018 |
| EP | 3744903 | A1 | 12/2020 |
| JP | 2005248502 | A | 9/2005 |
| JP | 2018178502 | A | 11/2018 |
| KR | 20150027451 | A | 3/2015 |

OTHER PUBLICATIONS

Search Report for German Application No. 102024118761.1, dated Feb. 6, 2025, 12 Pages.

* cited by examiner

COLLISION AVOIDANCE SYSTEM FOR AVOIDING COLLISION BETWEEN DIG COMPONENTS AND BLADE ON AN EXCAVATOR

FIELD OF THE DESCRIPTION

The present description generally relates to the use of equipment in worksite operations. More specifically, the present description relates to controlling and protecting the equipment from colliding with itself.

BACKGROUND

There is a wide variety of different types of equipment such as forestry equipment, construction equipment, among others. These types of equipment are often operated by an operator and have sensors that generate information during an operation.

Further, many different types of equipment can be equipped to use a variety of attachments. For example, excavators have many options for attachments. Some of these include buckets, grapples, augers, trench diggers, etc. Also, excavators are often equipped with a blade that is movably mounted to a lower frame of the excavator.

The discussion above is merely provided for general background information and is not intended to be used as an aid in determining the scope of the claimed subject matter.

SUMMARY

An excavator has a lower frame with a blade movably mounted to the lower frame. The excavator also has dig components such as a boom, an arm, and an attachment. The positions of the dig components are identified and a control signal generator controls movement of the dig component to avoid a collision between the boom or attachment and the blade.

Example 1 is a method of controlling a work machine, comprising:

- detecting a rotary position of a first frame on the work machine, to which a dig component is attached, relative to a second frame to which a blade is attached;
- detecting a position of the dig component;
- identifying a position of the blade;
- receiving a command input to actuate an actuator to move the dig component;
- determining whether execution of the command input will move the dig component to within a threshold separation distance of the blade; and
- if so, generating an action signal.

Example 2 is the method of any or all previous examples wherein generating an action signal comprises:

- controlling actuation of the actuator to limit movement of the dig component to maintain the threshold separation distance between the dig component and the blade.

Example 3 is the method of any or all previous examples wherein identifying a position of the blade comprises:

- capturing an image of the blade with an optical sensor; and
- performing image processing on the image to identify the position of the blade.

Example 4 is the method of any or all previous examples wherein generating an action signal comprises:

- if execution of the command input will move the dig component to within the threshold separation distance of the blade, generating an operator alert output.

Example 5 is a computer implemented method of controlling a work machine, comprising:

- detecting a rotary position of a first frame on the work machine, to which a dig component is attached, relative to a second frame to which a blade is attached;
- identifying a separation value indicative of a distance and direction separating the dig component from the blade;
- receiving a command input to actuate an actuator to move one of the dig component or the blade; and
- generating an action signal to control the work machine based on the command input, the rotary position, and the separation value.

Example 6 is the computer implemented method of any or all previous examples wherein generating an action signal comprises:

- controlling actuation of the actuator based on the command input, the rotary position, and the separation value.

Example 7 is the computer implemented method of any or all previous examples wherein controlling actuation of the actuator comprises:

- determining whether execution of the command input will reduce the separation value past a threshold separation distance; and
- if so, controlling actuation of the actuator to limit movement of the dig component or the blade to maintain the separation value at the threshold separation distance.

Example 8 is the computer implemented method of any or all previous examples wherein identifying a separation value comprises:

- detecting a position of the dig component relative to a position of the blade; and
- determining the separation value based on the position of the dig component relative to the position of the blade.

Example 9 is the computer implemented method of any or all previous examples wherein detecting a position of the dig component relative to a position of the blade comprises:

- detecting the position of the blade with a blade position sensor;
- detecting the position of the dig component with a dig component position sensor; and
- determining the separation value based on the detected position of the blade and the detected position of the dig component.

Example 10 is the computer implemented method of any or all previous examples wherein detecting a position of the blade comprises:

- capturing an image of the blade with an optical sensor; and
- performing image processing on the image to identify the position of the blade.

Example 11 is the computer implemented method of any or all previous examples wherein detecting a position of the dig component relative to a position of the blade comprises:

- obtaining a first blade position in which a distance between the blade and the dig component is least; and
- identifying the blade position based on the first blade position.

Example 12 is the computer implemented method of any or all previous examples wherein generating an action signal comprises:

- determining whether execution of the command input will reduce the separation value past a threshold separation distance; and
- if so, generating an operator alert output.

Example 13 is the computer implemented method of any or all previous examples wherein identifying a separation value indicative of a distance and direction separating the dig component from the blade, comprises:

detecting a location of the dig component on a vertical plane;

detecting a location of the blade on the vertical plane; and calculating the separation value based on the location of the dig component on the vertical plane and the location of the blade on the vertical plane.

Example 14 is the computer implemented method of any or all previous examples wherein identifying a separation value indicative of a distance and direction separating the dig component from the blade comprises:

identifying the separation value as indicative of the distance and direction of separation between the blade and at least one of a boom, an arm, or an attachment on the work machine.

Example 15 is a work machine, comprising:

a first frame;

a house supported by the first frame;

a dig component attached to the first frame;

a first actuator configured to drive movement of the dig component relative to the first frame;

a second frame;

a blade connected to the second frame;

a rotary actuator configured to drive rotation of the first frame relative to the second frame;

a rotary position detector configured to detect a rotary position of a first frame relative to the second; and a collision avoidance system configured to identify a position of the dig component and a position of the blade, to receive a command input to actuate the first actuator to move the dig component, and to generate an action signal to control the work machine based on the command input, the rotary position, the position of the dig component and the position of the blade.

Example 16 is the work machine of any or all previous examples wherein the collision avoidance system comprises:

an input command processor configured to determine whether execution of the command input will move the dig component to within a threshold separation distance of the blade; and a control signal generator configured to generate a control signal to control actuation of the first actuator to limit movement of the dig component to maintain the threshold separation distance between the dig component and the blade.

Example 17 is the work machine of any or all previous examples wherein the collision avoidance system comprises:

a position identifying system configured to identify a position of the dig component relative to a position of the blade.

Example 18 is the work machine of any or all previous examples wherein the position identifying system comprises:

a dig component position detector configured to detect a position of the dig component;

a second frame location system configured to identify a location of the second frame relative to the dig component; and a blade position identification system configured to identify a position of the blade relative to the second frame.

Example 19 is the work machine of any or all previous examples wherein the blade position identification system comprises:

a camera configured to capture an image of the blade; and an image processor configured to process the image to identify the position of the blade.

Example 20 is the work machine of any or all previous examples wherein the collision avoidance system comprises:

an input command processor configured to determine whether execution of the command input will move the dig component to within a threshold separation distance of the blade; and an alert generator configured to generate an operator alert output.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

As discussed above, excavators often have a lower frame which is mounted to ground engaging elements (such as tracks) and which is also coupled to a blade. The blade can be raised and lowered relative to the lower frame. The excavator also includes a house that is coupled for rotary motion relative to the lower frame. Digging equipment (such as a boom, arm and bucket or other attachment) are coupled to the house. Therefore, in some circumstances, the blade and digging equipment can collide with one another. Further, excavators may often be modular so that they can be coupled to a plurality of different attachments or tools (such as different types of buckets, grapples, augers, etc.). The different attachments or tools may have different sizes and may be movable in different degrees of freedom. This can make it difficult to control the digging equipment to avoid collision with the blade.

Figure 1:
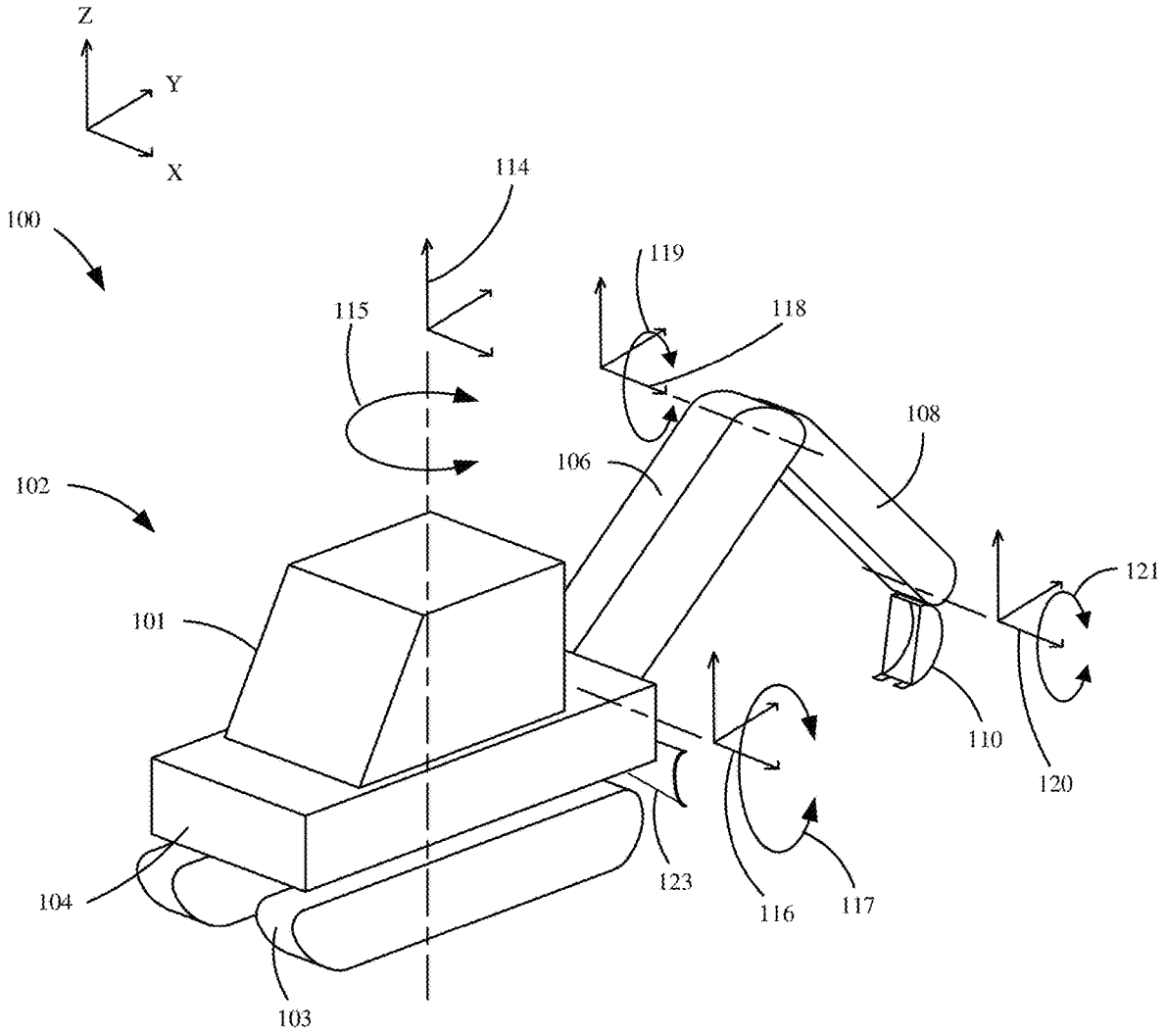
FIG. 1 is a perspective view of one example of a work machine.

FIG. 1 is a perspective view of one example of a work machine 102. Work machine 102 is operated either autonomously or by an operator located in operator compartment 101. Work machine 102 can include a variety of different controllable subsystems that each comprise a movable element and an actuator to actuate the movable element. In the example shown in FIG. 1, the movable elements of the controllable subsystems include tracks 103, house 104, boom 106, stick (or arm) 108, blade 123, and attachment 110.

Each movable element is driven by one or more corresponding actuators (such as hydraulic cylinders, or other actuators). Tracks 103 are mounted to a lower frame of machine 102 and are driven by an engine to guide and propel work machine 102 about a worksite 100. In other examples, tracks 103 can be replaced by wheels or other ground engaging elements.

Operator compartment 101 is coupled to the house 104 where internal components of work machine 102 are housed. Some of these internal components include an engine, transmission, hydraulic pumps, generators, etc. House 104 is supported by an upper frame and rotatably coupled relative to the lower frame of machine 102. House 104 is driven by an actuator to rotate about house axis 114 in the direction indicated by arrows 115.

Boom 106 is also rotatably coupled to the upper frame that supports house 104. Boom 106 rotates about boom axis 116 in the direction indicated by arrow 117. Stick or arm 108 is rotatably coupled to boom 106. Stick or arm 108 rotates about axis 118 in the direction indicated by arrow 119. Attachment 110 is shown as a bucket which is rotatably coupled to stick or arm 108. Attachment 110 rotates about attachment axis 120, in the direction indicated by arrow 121. As shown in FIG. 1, attachment 110 is a bucket, however, attachment 110 may be a wide variety of different attachments. For example, attachment 110 may be a grapple, an auger, a jackhammer, a trench digger, etc. FIG. 1 also shows that machine 102 includes a blade 123 that is movably coupled to the lower frame of machine 102. Blade 123 can be raised or lower relative to the lower frame of machine 102 by controlling an actuator.

In an example operation, an operator in operator compartment 102 can raise boom 106 by controlling an actuator to rotate boom 106 counterclockwise about axis 116. The operator can control actuators to rotate arm 108 clockwise about axis 118 and attachment 110 clockwise about axis 120. Moving these components in the way described may bring attachment 110 or boom 106 into contact with, and potentially damage, blade 123. A system described in greater detail below can limit movement of the movable elements to inhibit one part of machine 102 from contacting a protected portion of mobile machine 102 (e.g., to inhibit mobile machine 102 from harming itself).

Figure 2:
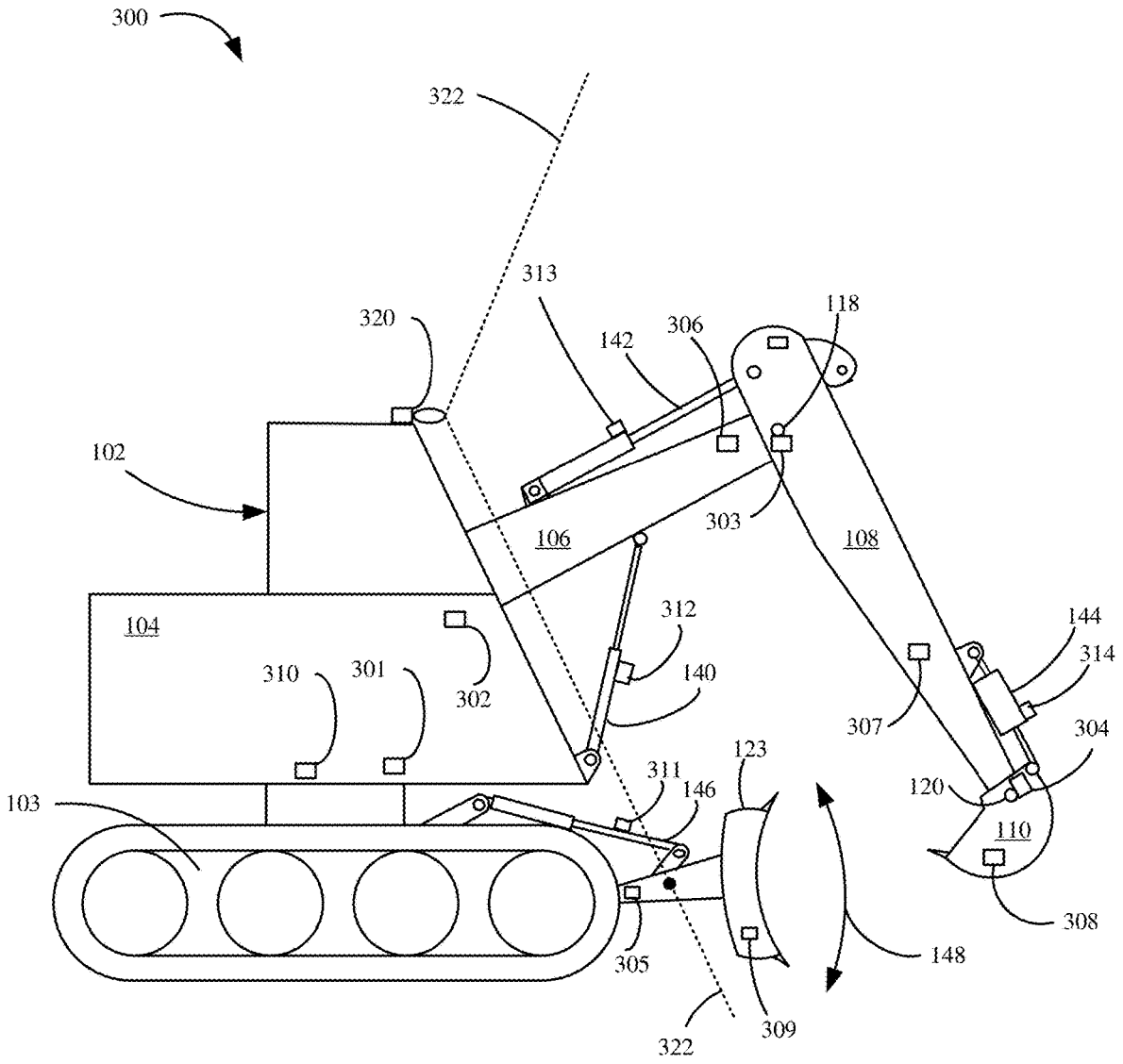
FIG. 2 is a side view of a work machine showing a plurality of sensors on the work machine.

FIG. 2 is a side view of another example of machine 102, in which similar items are similarly numbered to those shown in FIG. 1. FIG. 2 shows that actuator 140 can be extended to raise boom 106 and retracted it to lower boom 106. Actuator 142 can be extended and retracted to pivot arm 108 about the axis 118. Actuator 144 can be extended and retracted to pivot attachment 110 about axis 120. FIG. 2 also shows that actuator 146 can be extended and retracted to lower and raise blade 123 generally in the direction indicated by arrow 148.

FIG. 2 also shows a set of sensors that can be deployed on machine 102. Sensor 301, for instance, can be coupled to the linkage between house 104 and the lower frame of machine 102 that supports tracks 103. Sensor 301 can generate a signal indicative of a rotary position of house 104 relative to the lower frame of machine 102. Thus, sensor 301 can be a potentiometer, an angle encoder, or another sensor that measures the rotary position of house 104 relative to the lower frame of machine 102.

Sensor 302 is illustratively coupled to the linkage between boom 106 the upper frame which supports house 104 to measure the position of boom 106 relative to house 104. For instance, sensor 302 can be a potentiometer or an angle encoder or another sensor that measures the angle of rotation of boom 106 about axis 116. Sensor 303 is illustratively coupled to the linkage between boom 106 and arm 108. Sensor 303 illustratively measures the position of arm 108 relative to boom 106. Sensor 304 is coupled to the linkage between arm 108 and attachment 110. Sensor 304 generates a signal indicative of the position of attachment 110 relative to arm 108. Similarly, sensor 305 is coupled to the linkage between blade 123 and the lower frame of machine 102 to measure the position of blade 123 relative to the lower frame 102.

In addition to, or instead of sensors 301-305, machine 102 can have sensors 306-310 which may be inertial measurement units (IMUs) that track inertia, acceleration, and rotation of the movable elements to which they are mounted. Then, using kinematic information (for example), the position or movement of the movable elements can be mathematically calculated if the IMU is placed in a known position on the movable element. In addition, or instead, machine 102 can also have sensors 311-314. Sensors 311-314 may be linear displacement transducers (LDTs), such as magnetic resistive transducers, Hall Effect sensors, etc., that are coupled to corresponding hydraulic actuators that drive movement of the different moveable elements. For example, sensor 311 is coupled to actuator 146 that actuates movement of blade 123 relative to the lower frame of machine 102. Sensor 311 generates a signal indicative of the extent to which cylinder 146 is extended and is thus indicative of the position of blade 123 relative to the lower frame of machine 102. Sensor 312 can similarly detect the extent to which cylinder 140 is extended. Sensor 313 can detect the extent to which cylinder 142 is extended, and sensor 314 can detect the extent to which cylinder 144 is extended. Based upon these detected measurements, and based on other kinematic information, the location of the movable elements driven by the corresponding actuators can be identified as well.

Similarly, FIG. 2 shows that machine 102 can have a sensor 320 which may be a camera (a stereo camera or mono camera), a laser-based sensor, a RADAR or LIDAR-based sensor, or a similar type of sensor along with its corresponding image processing logic or other sensor signal detection and processing logic. These types of sensors have a line of sight or field of view, an example of which is indicated by dashed lines 322 in FIG. 2. The field of view of sensor 320 is a region in which sensor 320 can generate a signal indicative of a position of a component within its field of view defined by lines 322. For example, a camera can visually capture an image of blade 123. The processing logic can then identify the position of blade 123 in the image so the position of blade 123 relative to other moveable elements, such as relative to boom 106, attachment 110, etc. can be calculated.

Figure 3:
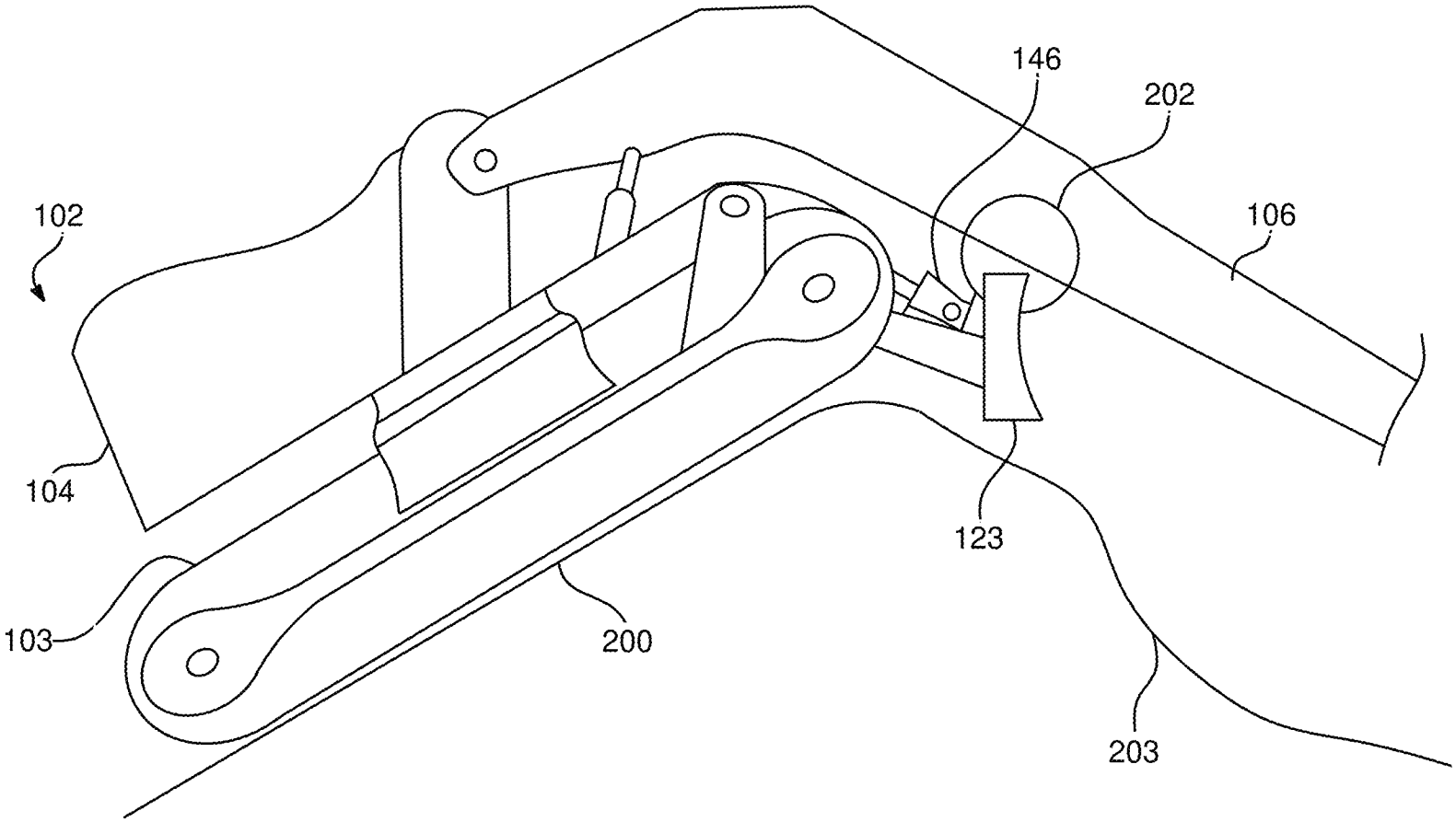
FIG. 3 is a side view of a portion of a work machine in which the work machine is oriented upwardly with the boom oriented downwardly and the boom colliding with the blade.

FIG. 3 is a side view of a portion of machine 102. FIG. 3 shows one example in which boom 106 is in a lowered position relative to blade 123. In the example shown in FIG. 3, machine 102 is oriented upwardly along a slope 200 so that boom 106 is lowered to excavate along the downward side of a slope 202. This means that the cylinder 140 driving boom 106 may be fully retracted. It can be seen, as illustrated at 202, that the lower edge of boom 106 has now collided with, or come into contact with, the upper edge of blade 123.

Figure 4:
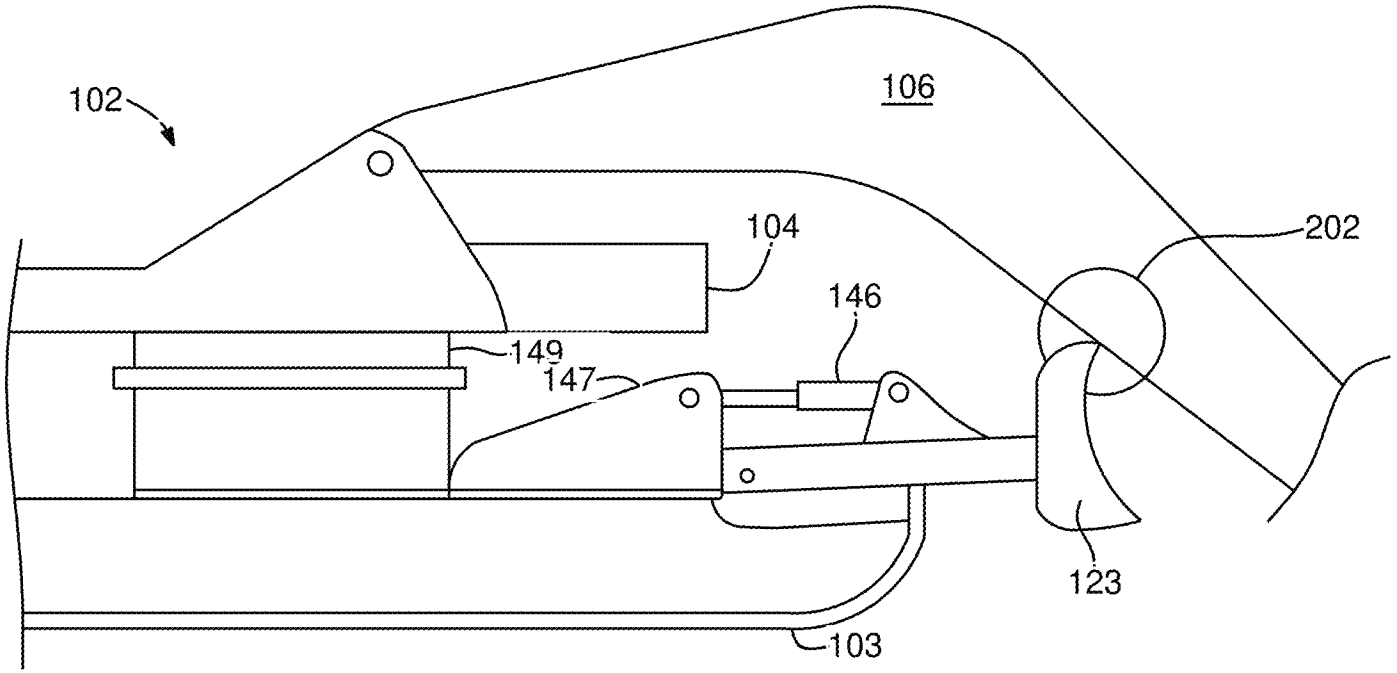
FIG. 4 is a side view of a portion of a work machine in which the boom is colliding with the blade.

FIG. 4 shows another example of a portion of machine 102 in which boom 106 is again lowered while blade 123 is raised. Thus, in the position shown in FIG. 4, even though machine 102 is on relatively level terrain, boom 106 still comes into contact with, or collides with, blade 123.

Figure 5:
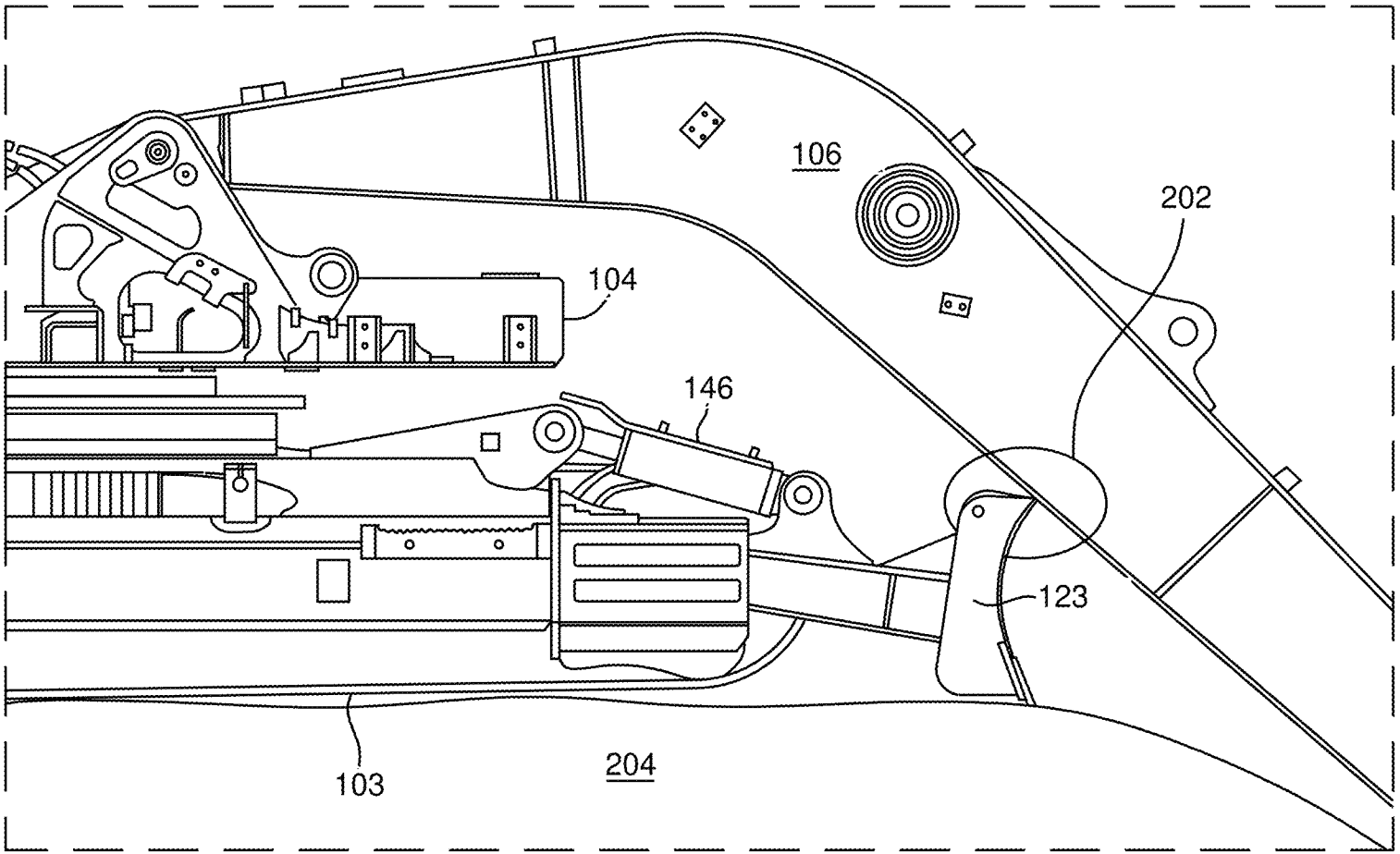
FIG. 5 is a side view of a portion the work machine in which the boom is colliding with the blade.

FIG. 5 shows another example in which, even though blade 123 is lowered to be resting on the ground 204, boom 106 is also lowered sufficiently that the lower surface of boom 106 is again contacting the upper surface of blade 123.

Figure 6:
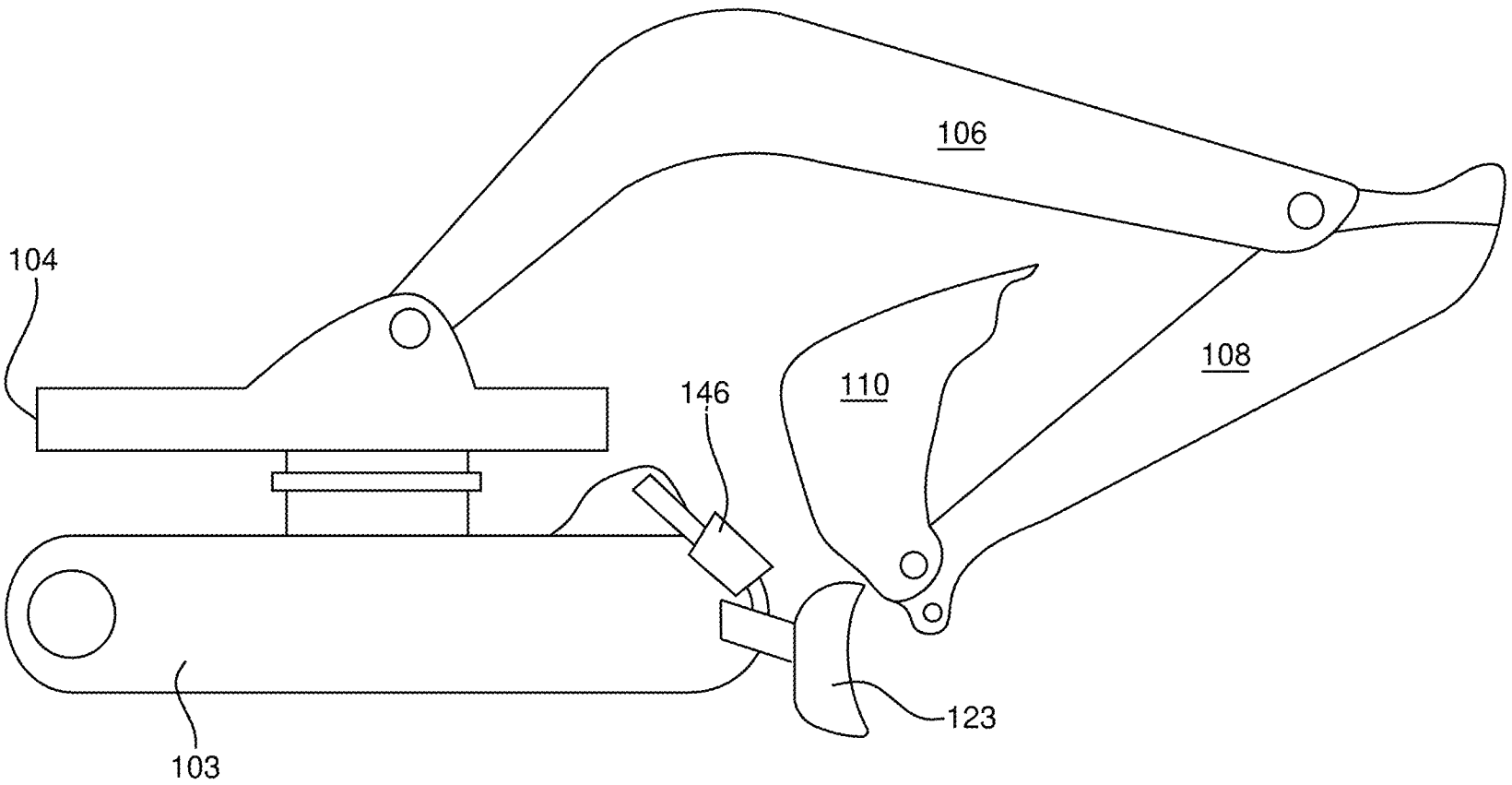
FIG. 6 is a side view of a portion of a work machine in which a tool or attachment is colliding with the blade.

FIG. 6 shows another example in which arm 108 is retracted relative to boom 106, and bucket 110 (which is illustrated as a relatively large bucket) is also fully retracted relative to arm 108. However, FIG. 6 shows that boom 106 has been lowered to a position such that bucket 110 is colliding with the upper edge of blade 123. The problem of the digging equipment colliding with blade 123 can be exacerbated when the attachment 110 is even larger or is movable in additional degrees of freedom, than bucket 110. This can make it even more difficult for an operator to control the machine so that the digging equipment does not collide with blade 123.

The present discussion thus proceeds with respect to a work machine 102 in which a collision avoidance system is used to limit the control of machine 102 so that a collision between the digging equipment on machine 102 and the blade 123 is avoided. In some current systems, the way such a collision is avoided is to instruct the operator to rotate the house 104 relative to the lower frame of machine 102 so that the machine is not digging over the top of blade 123. This type of system relies on the operator to carryout these instructions. The present description, on the other hand, includes an example in which the machine is automatically controlled to avoid such a collision, even if the house 104 is in a position such that the digging equipment is over the top of blade 123. In another example, however, the machine is controlled to generate an operator alert indicating that a collision is imminent or that the positions of the digging equipment and blade have come within a threshold range of one another.

Figure 7:
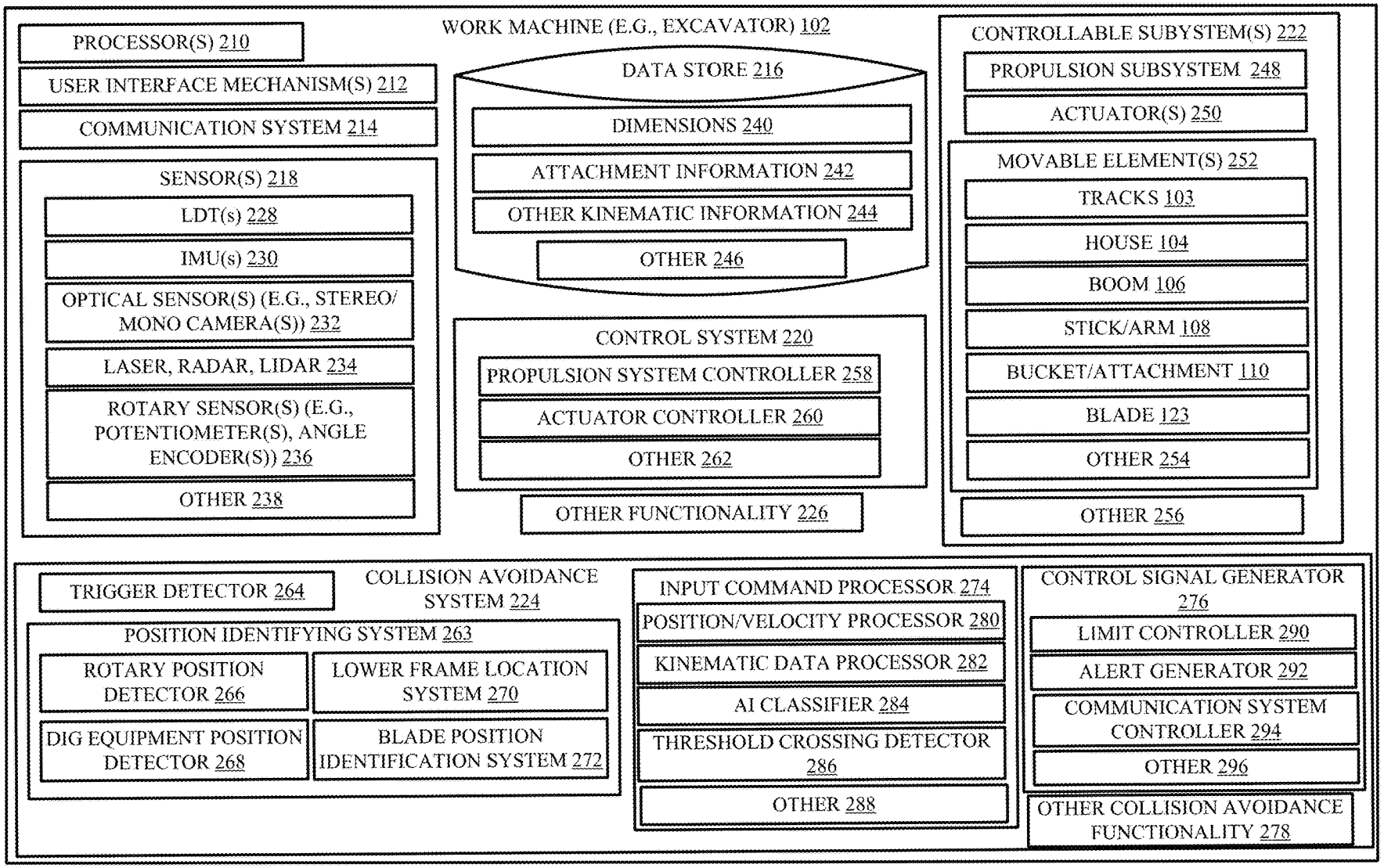
FIG. 7 is a block diagram showing one example of a work machine, in more detail.

FIG. 7 is a block diagram showing one example of such a machine 102, in more detail. In the example shown in FIG. 7, work machine (e.g., excavator) 102 includes one or more processors 210, user interface mechanisms 212, communication system 214, data store 216, sensors 218, control system 220, controllable subsystem 222, collision avoidance system 224, and a wide variety of other machine functionality 226. Sensors 218 can include any or all of the sensors discussed above, including LDTs 228, IMUs 230, optical sensors (e.g., stereo/mono cameras) 232, laser, RADAR, LIDAR or other similar sensors 234, rotary sensors (e.g., potentiometers, angle encoders, etc.) 236, and other sensors 238. Sensors 218 can generate a signal indicative of the position of the movable elements either in absolute coordinates or relative to one another and relative to other parts of machine 102.

Data store 216 can store dimensions 240, attachment information 242 (which may be an index of different attachments and their corresponding dimension and degree of freedom information), other kinematic information 244 which can be used to calculate the position of different moveable elements on machine 102, and any of a wide variety of other information 246. Controllable subsystems 222 can include propulsion system 248 which provides propulsion to machine 102, and a plurality of actuators 250 (which can include the rotary actuator that drives rotary movement of house 104 relative to lower frame of machine 102), the various actuators 140, 142, 144, and 146 which drive movement of the movable elements on machine 102, and any of a wide variety of other actuators. Controllable subsystems 222 can include moveable elements 252 such as tracks 103, house 104, boom 106, stick or arm 108, bucket or attachment 110, blade 123, and any of a variety of other movable elements 254. Controllable subsystems 222 can include other subsystems 256 as well.

Control system 220 includes propulsion system controller 258, actuator controller 260, and other items 262. Collision avoidance system 224 includes trigger detector 264, rotary position detector 266, dig equipment position detector 268, lower frame location system 270, blade position identification system 272, input command processor 274, control signal generator 276, and other collision avoidance functionality 278. Input command processor 274 can include position/velocity processor 280, kinematic data processor 282, artificial intelligence (AI) or other machine learning classifier 284, threshold crossing detector 286, and other items 288. Control signal generator 276 can include limit controller 290, alert generator 292, communication system controller 294, and other items 296. Before describing the overall operation of work machine 102 and avoiding collisions between the digging equipment and blade 123, a brief description of some of the items in FIG. 7 and their operation, will first be provided.

An operator can control and interact with machine 102 through user interface mechanisms 212. User interface mechanisms 212 can include a variety of different mechanisms including displays, touch screens, levers, pedals, steering wheel, joysticks, etc. Actuation of user interface mechanisms 212 can activate control system 220 to generate a control signal to control controllable subsystems 222. For instance, moving a lever or a joystick may cause actuator controller 260 to send a control signal to actuators 250 to rotate house 104 relative to the lower frame of machine 102, to raise or lower boom 108 and/or stick or arm 108, to manipulate bucket or other attachment 110, to raise or lower blade 123, etc. An operator input can also cause actuator controller 260 to generate a control signal to control propulsion system 248 to move and steer machine 102.

Communication system 214 illustratively facilitates communication of the items of work machine 102 with one another, and may also facilitate communication with other machines or other systems over a network. The network may be a wide area network, a local area network, a near field communication network, a Wi-Fi or Bluetooth network, a cellular communication network, or any of a wide variety of other networks or combinations of networks. Therefore, communication system 214 may be a controller area network (CAN) bus and bus controller, and other communication system functionality to communicate over other networks.

Collision avoidance system 224 may receive inputs from the various sensors 218 and obtain information from data store 216 and then generate an action signal to control the operation of machine 102 to avoid collisions between the digging equipment and blade 123, to generate an alert message for an operator, etc. Thus, trigger detector 264 detects when collision avoidance system 224 is to operate to avoid such collisions. The trigger detector may detect various trigger criteria, such as an operator input engaging collision avoidance system 224, inputs indicating that the digging equipment is about to collide with blade 123, or other trigger criteria. Once triggered, rotary position detector 266 receives an input from rotary sensor 236 to identify the position of house 104 relative to the lower frame of machine 102. This may be used to determine whether boom 106 is over blade 123 or whether the house is rotated sufficiently that boom 106 will not collide with blade 103 when house 104 is in its present position relative to the lower frame of machine 102.

Thus, rotary position detector 266 may receive a signal from rotary sensor 236. The signal may indicate, by itself, the rotary position of house 104 relative to the lower frame of a machine 102, or detector 266 may access dimensions 240, or other kinematic information 244 to determine, based upon the rotary sensor signal from sensor 236, the position of house 104 relative to the lower frame of machine 102.

Dig equipment position detector 268 receives a signal from one or more sensors 218 and identifies the position of boom 106, arm 108, and/or attachment 110 either relative to one another or relative to the lower frame of machine 102, and/or relative to blade 123, or relative to another known position. Lower frame location system 270 locates the lower frame of machine 102 relative to the boom 106, arm 108, and attachment 110. Thus, by obtaining the position of the boom 106, arm 108, and attachment 110, and by obtaining dimensions 240, or other kinematic information 244, system 270 can determine the location of boom 106, arm 108, and/or attachment 110 relative to the lower frame of machine 102, or relative to a known position on the lower frame. Blade position identification system 272 can receive an input from one or more of the sensors 218 that are indicative of whether blade 123 is raised, or lowered, and the extent to which it is raised or lowered. Blade position identification system 272 can then identify (based upon dimension information 240, attachment information 242, other kinematic information 244, etc.), the position of the blade 123 relative to boom 106 and/or attachment 110, or relative to the position of the lower frame on machine 102. Ultimately, detectors 266 and 268 and systems 270 and 272 identify the position of blade 123 relative to the position of any of the digging equipment (boom 106, arm 108, and/or attachment 110) that may come into contact with or collide with blade 123. For example, trigonometry, kinematics, geometry, and one or more sensor signals and dimension information or attachment information 242 or other kinematic information 244 can be used to determine the position of a movable element. The dimensions 240 may be received as operator inputs or retrieved from another data store. For instance, the dimension information 240, attachment information 242, and other kinematic information 244 can be previously entered by an operator, preloaded by a machine manufacturer, or retrieved from a remote source.

The position of blade 123 and the positions of the other digging equipment can be identified in a global or local coordinate system. In another example, the relative positions of the of blade 123 relative to the other items of digging equipment, can be identified.

Input command processor 274 then receives an input command which is commanding at least one item of the digging equipment to move, or the blade to move, or the house 104 to rotate. Input command processor 274 then determines whether, if that command is carried out, it will result in a collision between any of the items of digging equipment and blade 123 or whether it will result in any of the items of digging equipment and blade 123 coming within a threshold distance of one another.

Position/velocity processor 208 can identify the position of the digging equipment and the blade 123 and the velocity (speed and direction) that the input command will, if executed, move the digging equipment relative to the blade 123. Kinematic data processor 282 can track the trajectory of the digging equipment relative to the blade through space, given the input from sensors 218 and given the data from data store 216, as well as the inputs from detectors 266 and 268 and systems 270 and 272. AI classifier 284 can be an artificial neural network, a deep learning system, a machine learning system, or another system that takes, as inputs, the positions of the digging equipment and blade 123 as well as the commanded input, and generates an output indicative of whether the commanded input will result in a collision or will result in the digging equipment coming within a threshold distance of blade 123.

Threshold crossing detector 286 can determine whether the commanded input will result in the digging equipment coming within a threshold distance of blade 123. Limit controller 290 receives an input from input command processor 274 and generates control signals to control actuator controller 260 to limit the movement of the controllable subsystems 222 to avoid a collision between the digging equipment and the blade 123. For instance, where the commanded input would result in such a collision, then limit controller 290 generates an output to modify the commanded output so that actuator controller 262 is controlled to stop short of the collision. Alert generator 292 can generate a control signal to control user interface mechanisms 212 to output an alert for the operator. The alert may indicate that the commanded input will result in a collision or will result in the digging equipment coming within a threshold distance of blade 123. Communication system controller 294 can control communication system 214 to communicate the results of the information generated by collision avoidance system 224 to another machine, or to an external system. For instance, assume that the operator of machine 102 is an automated system. Assume further that the automated system is generating a high volume of command inputs which would result in the digging equipment colliding with the blade. In that case, this information may be useful in modifying the automated operator to avoid such operator inputs in the future or to otherwise control machine 102 in a more satisfactory way. Similarly, where alert generator 292 generates an operator alert, but the operator continues with the commanded input, resulting in a collision, this information may be useful as well.

Figure 8A:
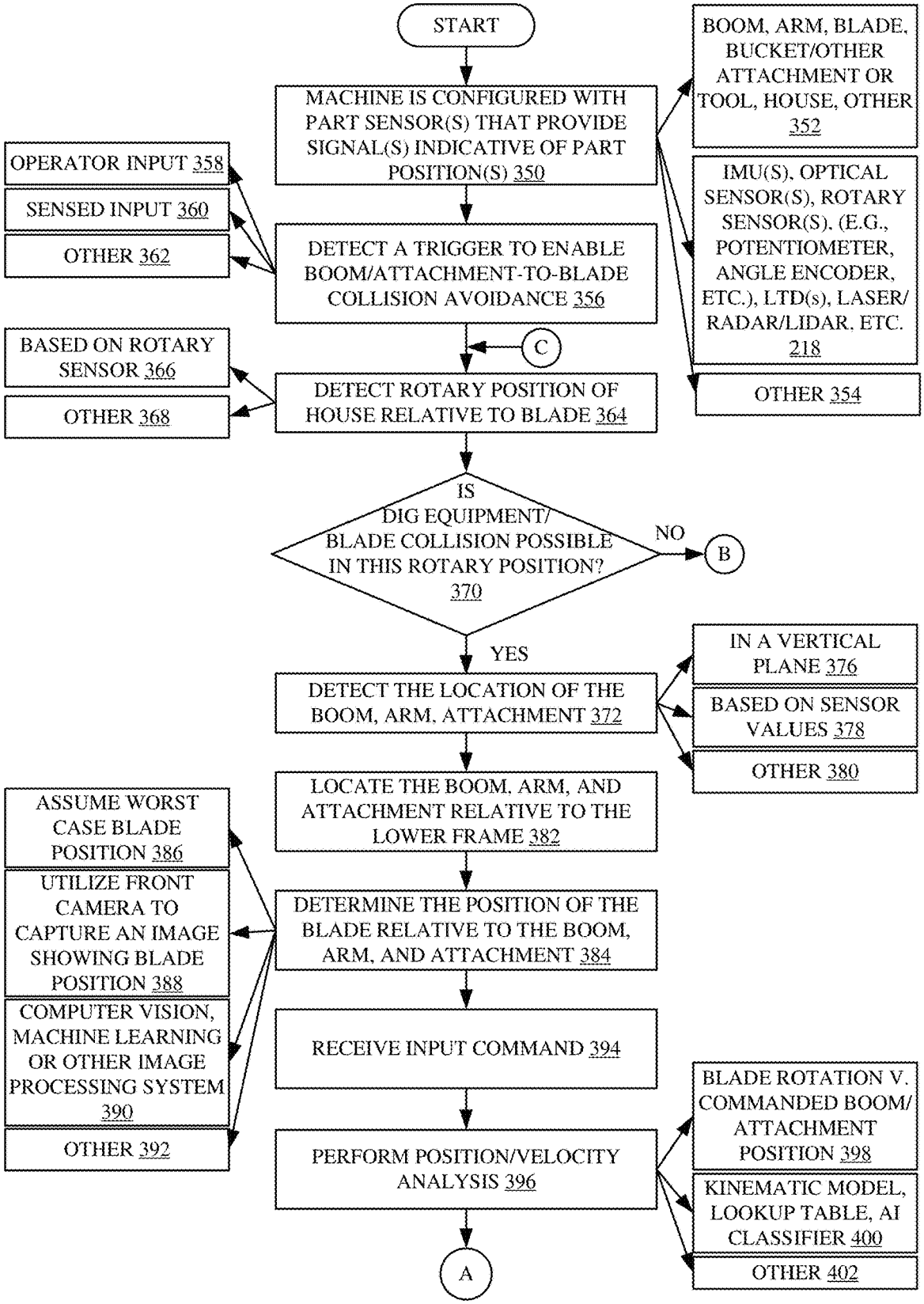
FIGS. 8A-8B (collectively referred to herein as FIG. 8) illustrate a flow diagram showing one example of the operation of the work machine in avoiding a collision between the digging equipment and the blade.
Figure 8B:
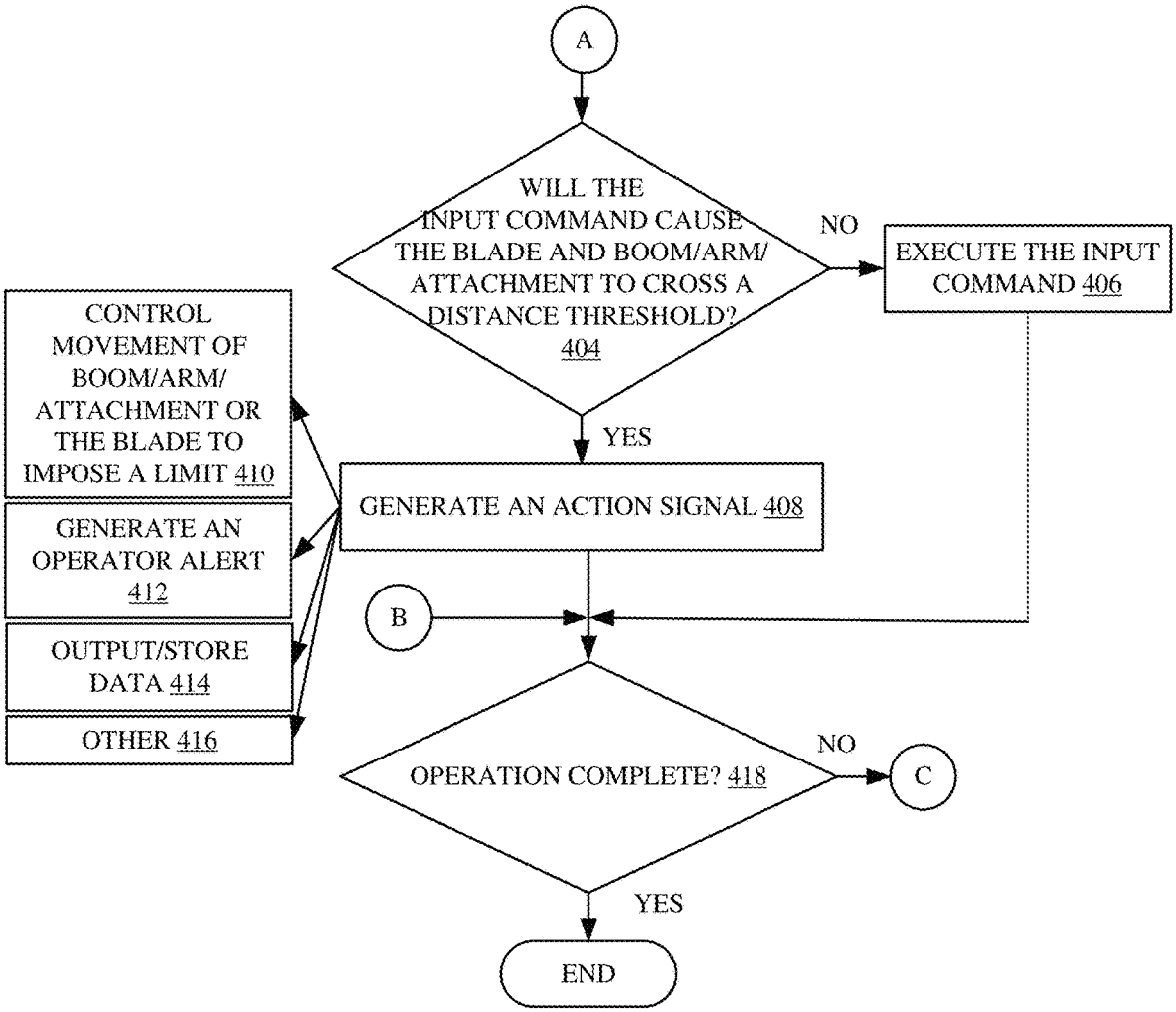

FIGS. 8A and 8B show a flow diagram illustrating one example of the operation of collision avoidance system 224 in controlling machine 102 to avoid a collision between the digging equipment (e.g., boom 106, arm 108, and/or attachment 110) and blade 123. It is first assumed that machine 102 is configured with sensors 218 that provide signals indicative of the positions of the various parts that those sensors sense. Configuring machine 102 in this way is indicated by block 350 in the flow diagram of FIG. 8. In one example, boom 106, arm 108, blade 123, bucket or other attachment or tool 110, and house 104 all have sensors that identify the position of those corresponding parts either in coordinates in a local or global coordinate system, relative to one another, or relative to a known position on machine 102 or elsewhere. Providing the digging equipment (boom 106, arm 108, and bucket 110) as well as blade 123 and house 104 with such sensors is indicated by block 352 in the flow diagram of FIG. 8. As discussed above, the sensors 218 can be IMUs 230, optical sensors 232, rotary sensors 236, LDTs 228, LASER/RADAR/LIDAR based sensors 234 or other sensors 238. Configuring machine 102 can be configured in other ways in order to sense the position of the digging equipment in blade 123 as well, as indicated by block 254 in the flow diagram of FIG. 8. At some point, trigger detector 264 detects a trigger that triggers collision avoidance system 224, as indicated by block 356 in the flow diagram of FIG. 8. The trigger can be an operator input 258, a sensed input 360, or other trigger criteria 362.

Rotary position detector 266 then detects the rotary position of house 104 based upon an input from one of rotary sensors 236, as indicated by blocks 364 and 366 in the flow diagram of FIG. 8. The rotary position of house 104 relative to the blade 123 can be identified in other ways as well, as indicated by block 368. In one example, rotary position detector 366 detects the rotary position of house 104 relative to the lower frame. The position of blade 173 on the lower frame can be calculated or known and used to identify the rotary position of house 104 relative to blade 123. The rotary position of house 104 relative to blade 123 is indicative of whether the dig components (e.g., boom 106 or attachment 110) can possibly collide with blade 123 in the current rotary position of house 104, as indicated by block 370. For instance, if house 104 is rotated so that boom 106 extends rearwardly relative to blade 123 (or in the opposite direction of blade 123 from the lower frame of machine 102) then a collision between the dig equipment (e.g., boom 106, arm 108, or attachment 110) and blade 123 is not possible. Similarly, if house 104 is rotated so that boom 106 is not positioned over blade 123 but is instead positioned off to one side of blade 123, then, again, a collision between the dig equipment and blade 123 may not be possible in this rotary position.

Assume, however, at block 370, that the rotary position of house 104 relative to the lower frame of machine 102 (or relative to blade 123) is such that a collision between the dig equipment and blade 123 could take place, then dig equipment position detector 268 detects the location of the boom 106, arm 108, and attachment 110, as indicated by block 372 in the flow diagram of FIG. 8. By way of example, the location of the dig equipment can be identified in a vertical plane such as vertical plane 374 shown in FIG. 9. The position of the dig equipment in vertical plane 374 can be identified to then determine how close the items of dig equipment are to blade 123. Finding the position of the dig equipment in the vertical plane 374 is indicated by block 376 in the flow diagram of FIG. 8.

Figure 9:
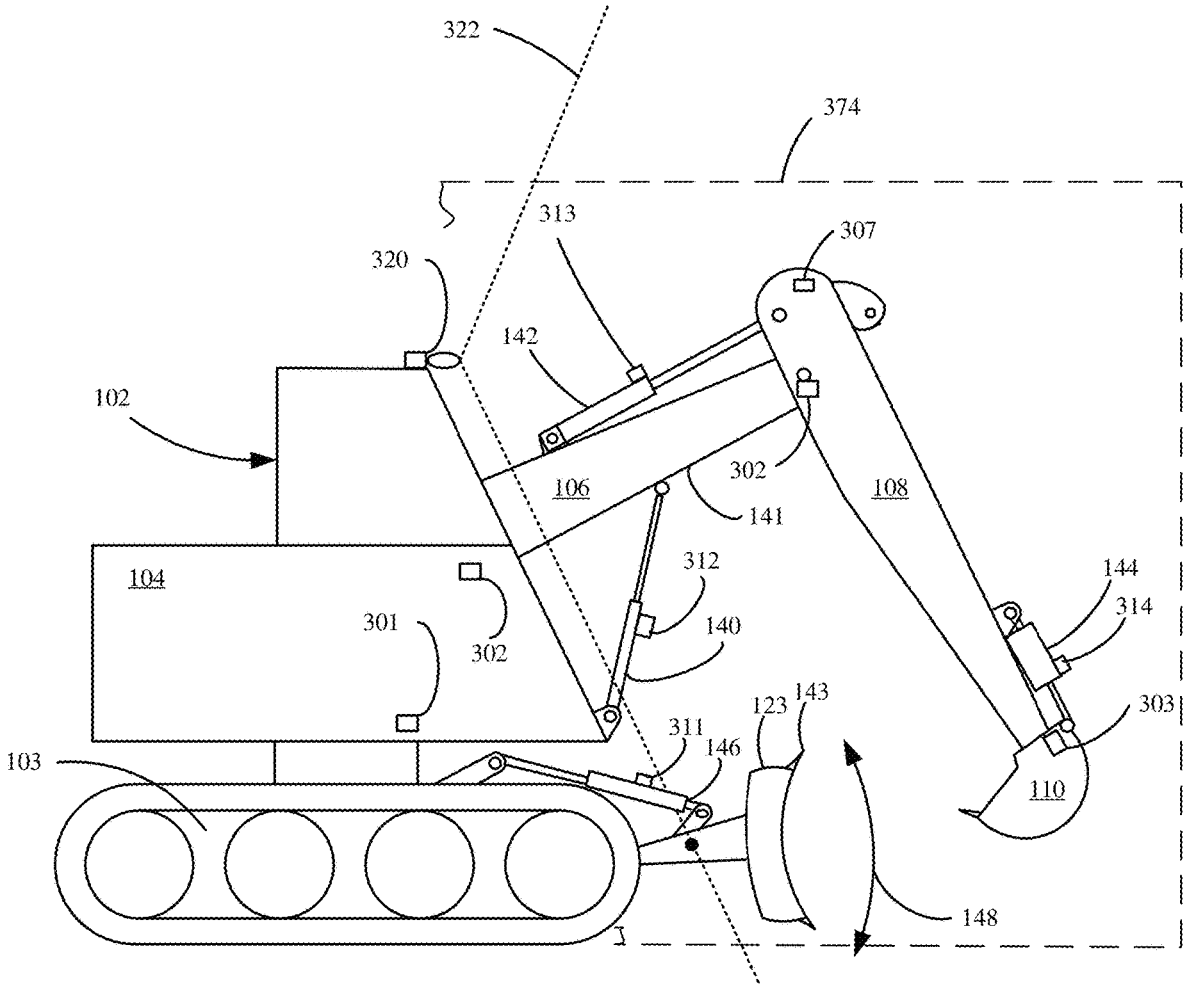
FIG. 9 is a side view of one example of a work machine in which the location or position of the digging equipment and the blade are identified in a vertical plane.

The position of the periphery of each item of dig equipment can be found by identifying the position of a sensor corresponding to that item of dig equipment, along with the dimensions 240 of the dig equipment. For instance, each of the sensors may provide an output indicative of the location of the corresponding piece of dig equipment. In FIG. 9, for instance, it can be seen that the sensors are LDTs 311, 312, 313 and 314. Sensors 311-314 provide a sensor signal indicating how far the corresponding actuator (e.g., cylinders 136, 140, 142 and 144) are extended. By knowing the length of extension of each of the actuators and the geometry or dimensions of the corresponding piece of dig equipment, then the location of the periphery of the dig equipment in vertical plane 374 can be known. For instance, by knowing how thick boom 106 is and where cylinder 140 attaches to boom 106, and then by knowing how far cylinder 140 is extended and where it attaches to the upper frame of machine 102, the position of the lower edge 141 of boom 106 in vertical plane 374 can be identified. In the same way, the upper edge 143 of blade 123 can also be identified. Therefore, the location of the lower edge 141 of boom 106 relative to the upper edge 143 of blade 123 can be calculated.

Identifying the location of boom 106, arm 108, and/or attachment 110 based on sensor values is indicated by block 378 in the flow diagram of FIG. 8. The location of the dig equipment can be identified in other ways as well, as indicated by block 380.

Locating the boom 106 and attachment 110 (and other dig equipment) relative to the lower frame of machine 102 to which blade 143 is attached is indicated by block 382. Lower frame location system 270 can generate an output indicative of this location by, again, knowing dimension information which identifies the location of the lower frame relative to the known points on the upper frame (such as where cylinder 140 is attached to the upper frame, where boom 106 is attached to the upper frame, etc.). Blade position identification system 272 determines the position of the blade 123 relative to the boom 106 and attachment 110, as indicated by block 384. Again, as discussed above, system 272 can identify the location of the upper edge 143 of blade 123 in the vertical plane 374 to determine the position of the blade 123 relative to the boom 106 and attachment 110.

In one example, the location of blade 123 does not need to be detected. Instead, the system can identify the worst case position of blade 123 (such as the fully raised position where blade 123 is closest to the digging equipment) and assume that blade 123 is in its worst case position, as indicated by block 386. This alleviates the need to detect the actual position of blade 123. In another example, the actual position of blade 123 can be detected, such as using camera 320 to capture an image showing the blade position, as indicated by block 388. In addition, computer vision or a machine learning system in blade position identification system 272 can process the captured image to identify the location of the upper edge of blade 143 relative to the items of digging equipment (boom 106, arm 108, and attachment 110) as indicated by block 390 in the flow diagram of FIG. 8. In another example, the position of blade 123 can be identified in the image and, knowing the position and orientation of the camera 320, the location of blade 123 relative to other points on machine 102 and/or relative to the dig equipment can be calculated. The position of the blade 123 relative to the boom 106, arm 108, and/or attachment 110 can be identified in other ways as well, as indicated by block 392.

Input command processor 274 then receives an input command, such as through user interface mechanisms 212, commanding movement of blade 123 and/or an item of dig equipment (such as boom 106, arm 108, and/or attachment 110). Receiving an input command is indicated by block 394 in the flow diagram of FIG. 8.

Position/velocity processor 280 can then perform a position/velocity analysis to determine whether execution of the commanded input will cause any of the dig equipment to collide with, or come under desirably close to (e.g., within a threshold distance of), the blade 123. Performing the position/velocity analysis is indicated by block 396 in the flow diagram of FIG. 8. The analysis can provide an output indicative of the resultant position of blade 123 relative to the dig equipment once the commanded input is executed, as indicated by block 398 in the flow diagram of FIG. 8. The analysis can be performed using a kinematic model, a lookup table (e.g., which provides an output based upon the current position of the dig equipment and blade, and given a commanded input), using an artificial intelligence or machine learning classifier, or using other components, as indicated by blocks 400 and 402 in the flow diagram of FIG. 8.

If input command processor 274 determines that the commanded input will not cause the blade to collide with any of the dig equipment or come within a threshold distance of the dig equipment, as determined at block 404, then the input command is simply executed to move the dig equipment as commanded, and as indicated by block 406.

If input command processor 274 determines that the input command will cause the blade 123 and the digging equipment (boom/arm/attachment) to come within a threshold distance of one another, as determined at block 404, then control signal generator 276 generates an action signal based on this determination, as indicated by block 408.

The action signal can be generated by limit controller 290 to limit movement of the boom/arm/attachment or the blade to impose a limit on the movement so that the dig equipment does not collide with (or come within a threshold distance of) the blade 123. Generating a limit action signal to control movement of the dig equipment and/or the blade is indicated by block 410 in the flow diagram of FIG. 8.

Alert generator 292 can generate an operator alert to alert the operator using user interface mechanisms 212. The alert may notify the operator that executing the commanded input will result in a collision or result in the dig equipment coming within a threshold distance of the blade 123. In one example, the operator may be allowed to override the alert or continue with the commanded input. In another example, the alert is provided along with the limit signal so that not only is the movement of the dig equipment and/or the blade limited to avoid a collision, but the operator is also alerted that the commanded input would have caused a collision, but that movement has been limited. Generating an operator alert is indicated by block 412 in the flow diagram of FIG. 8.

In another example, communication system controller 294 can generate a control signal to control communication system 214. Communication system 214 can communicate information generated by collision avoidance system 224 to another system, to another machine, etc., or to a data store where the data can be stored and later analyzed. Generating such a communication control signal is indicated by block 414 in the flow diagram of FIG. 8. Control signal generator 276 can generate any of a wide variety of other action signals as well, as indicated by block 416. Until the operation is complete or until the collision avoidance system 224 is no longer triggered, operation reverts to block 364 where the rotary position of the house relative to blade 123 is monitored or detected.

It can thus be seen that the present description proceeds with respect to a system that generates control signals to control an excavator or other machine 102 so that collisions between the dig equipment (boom 106, arm 108, and/or attachment 110) and the blade 123 are avoided. Where sensors are provided to sense the position of blade 123, those sensors can be used. However, where no sensor is provided to detect the position of blade 123, then the system assumes the worst possible position of blade 123 (the position in which a collision with the dig equipment is most likely) and processes commanded inputs assuming that worst position. The control signals can be used to limit movement of the dig equipment and/or blade, or to generate an alert signal, or both.

The present discussion has mentioned processors and servers. In one example, the processors and servers include computer processors with associated memory and timing circuitry, not separately shown. The processors and servers are functional parts of the systems or devices to which they belong and are activated by, and facilitate the functionality of the other components or items in those systems.

Also, a number of user interface (UI) displays have been discussed. The UI displays can take a wide variety of different forms and can have a wide variety of different user actuatable input mechanisms disposed thereon. For instance, the user actuatable input mechanisms can be text boxes, check boxes, icons, links, drop-down menus, search boxes, etc. The mechanisms can also be actuated in a wide variety of different ways. For instance, the mechanisms can be actuated using a point and click device (such as a track ball or mouse). The mechanisms can be actuated using hardware buttons, switches, a joystick or keyboard, thumb switches or thumb pads, etc. The mechanisms can also be actuated using a virtual keyboard or other virtual actuators. In addition, where the screen on which the mechanisms are displayed is a touch sensitive screen, the mechanisms can be actuated using touch gestures. Also, where the device that displays them has speech recognition components, the mechanisms can be actuated using speech commands.

A number of data stores have also been discussed. It will be noted the data stores can each be broken into multiple data stores. All can be local to the systems accessing them, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

It will be noted that the above discussion has described a variety of different systems, components, controllers, sensors, detectors, and/or logic. It will be appreciated that such systems, components, controllers, sensors, detectors, and/or logic can be comprised of hardware items (such as processors and associated memory, or other processing components, some of which are described below) that perform the functions associated with those systems, components, controllers, sensors, detectors, and/or logic. In addition, the systems, components, controllers, sensors, detectors, and/or logic can be comprised of software that is loaded into a memory and is subsequently executed by a processor or server, or other computing component, as described below. The systems, components, controllers, sensors, detectors, and/or logic can also be comprised of different combinations of hardware, software, firmware, etc., some examples of which are described below. These are only some examples of different structures that can be used to form the systems, components, controllers, sensors, detectors, and/or logic described above. Other structures can be used as well.

Figure 10:
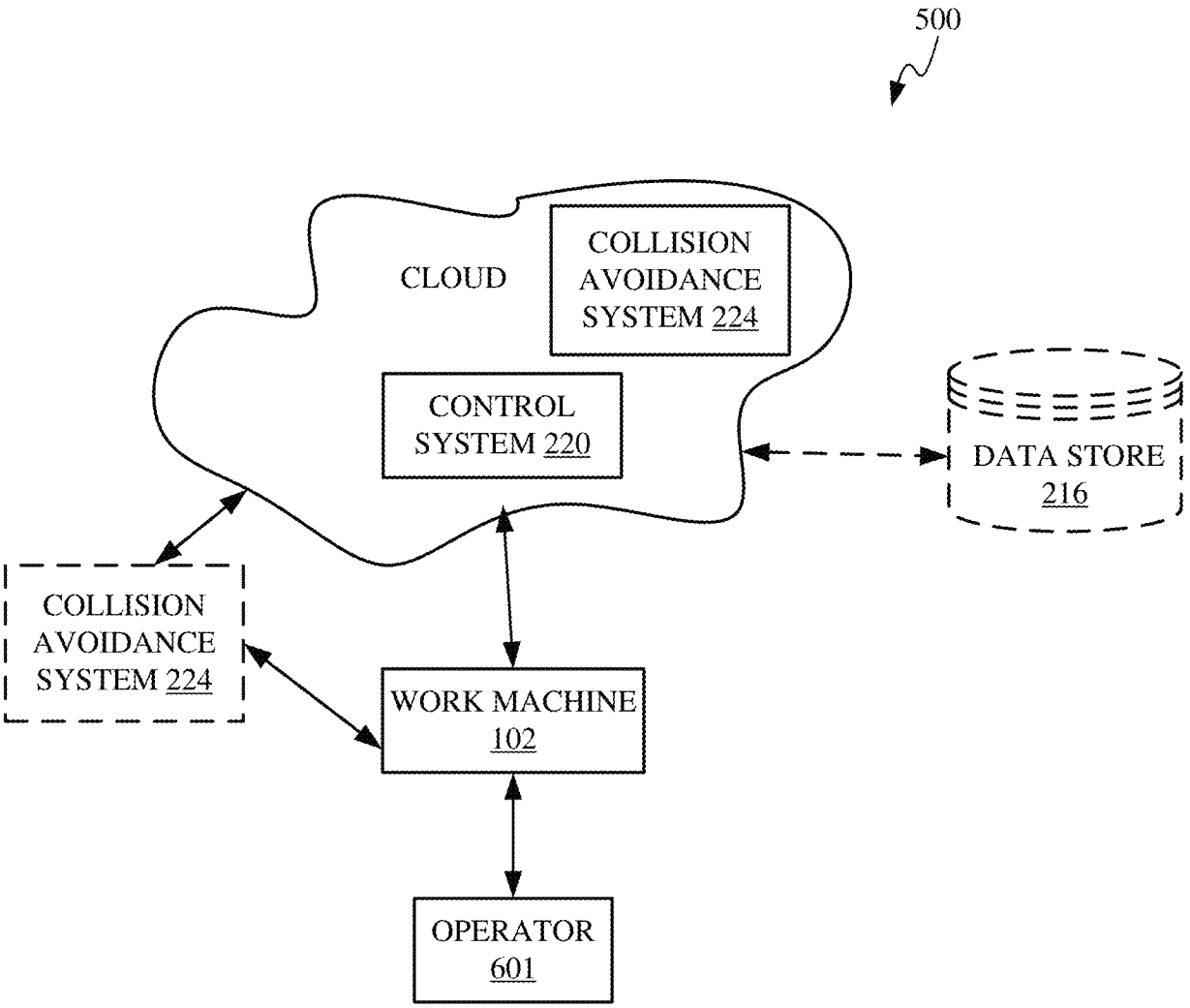
FIG. 10 is a block diagram showing one example of the work machine in a remote server environment.

FIG. 10 is a block diagram of machine 102, shown in FIG. 1, except that it communicates with elements in a remote server architecture 500. In an example, remote server architecture 500 can provide computation, software, data access, and storage services that do not require end-user knowledge of the physical location or configuration of the system that delivers the services. In various examples, remote servers can deliver the services over a wide area network, such as the internet, using appropriate protocols. For instance, remote servers can deliver applications over a wide area network and they can be accessed through a web browser or any other computing component. Software or components shown in previous FIGS. as well as the corresponding data, can be stored on servers at a remote location. The computing resources in a remote server environment can be consolidated at a remote data center location or they can be dispersed. Remote server infrastructures can deliver services through shared data centers, even though they appear as a single point of access for the user. Thus, the components and functions described herein can be provided from a remote server at a remote location using a remote server architecture. Alternatively, they can be provided from a conventional server, or they can be installed on client devices directly, or in other ways.

In the example shown in FIG. 10, some items are similar to those shown in previous FIGS. and they are similarly numbered. FIG. 10 specifically shows that collision avoidance system 224 can be located at a remote server location 502. Therefore, machine 102 accesses those systems through remote server location 502.

FIG. 10 also depicts another example of a remote server architecture. FIG. 10 shows that it is also contemplated that some elements of previous FIGS are disposed at remote server location 502 while others are not. By way of example, data store 216 can be disposed at a location separate from location 502, and accessed through the remote server at location 502. Regardless of where the items are located, the items can be accessed directly by machine 102, through a network (either a wide area network or a local area network), the items can be hosted at a remote site by a service, or the items can be provided as a service, or accessed by a connection service that resides in a remote location. Also, the data can be stored in substantially any location and intermittently accessed by, or forwarded to, interested parties. For instance, physical carriers can be used instead of, or in addition to, electromagnetic wave carriers. In such an example, where cell coverage is poor or nonexistent, another mobile machine (such as a fuel truck) can have an automated information collection system. As the machine 102 comes close to the fuel truck for fueling, the system automatically collects the information from the machine 102 using any type of ad-hoc wireless connection. The collected information can then be forwarded to the main network as the fuel truck reaches a location where there is cellular coverage (or other wireless coverage). For instance, the fuel truck may enter a covered location when traveling to fuel other machines or when at a main fuel storage location. All of these architectures are contemplated herein. Further, the information can be stored on the machine 102 until the machine 102 enters a covered location. The machine 102, itself, can then send the information to the main network.

It will also be noted that the elements of previous FIGS., or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 11:
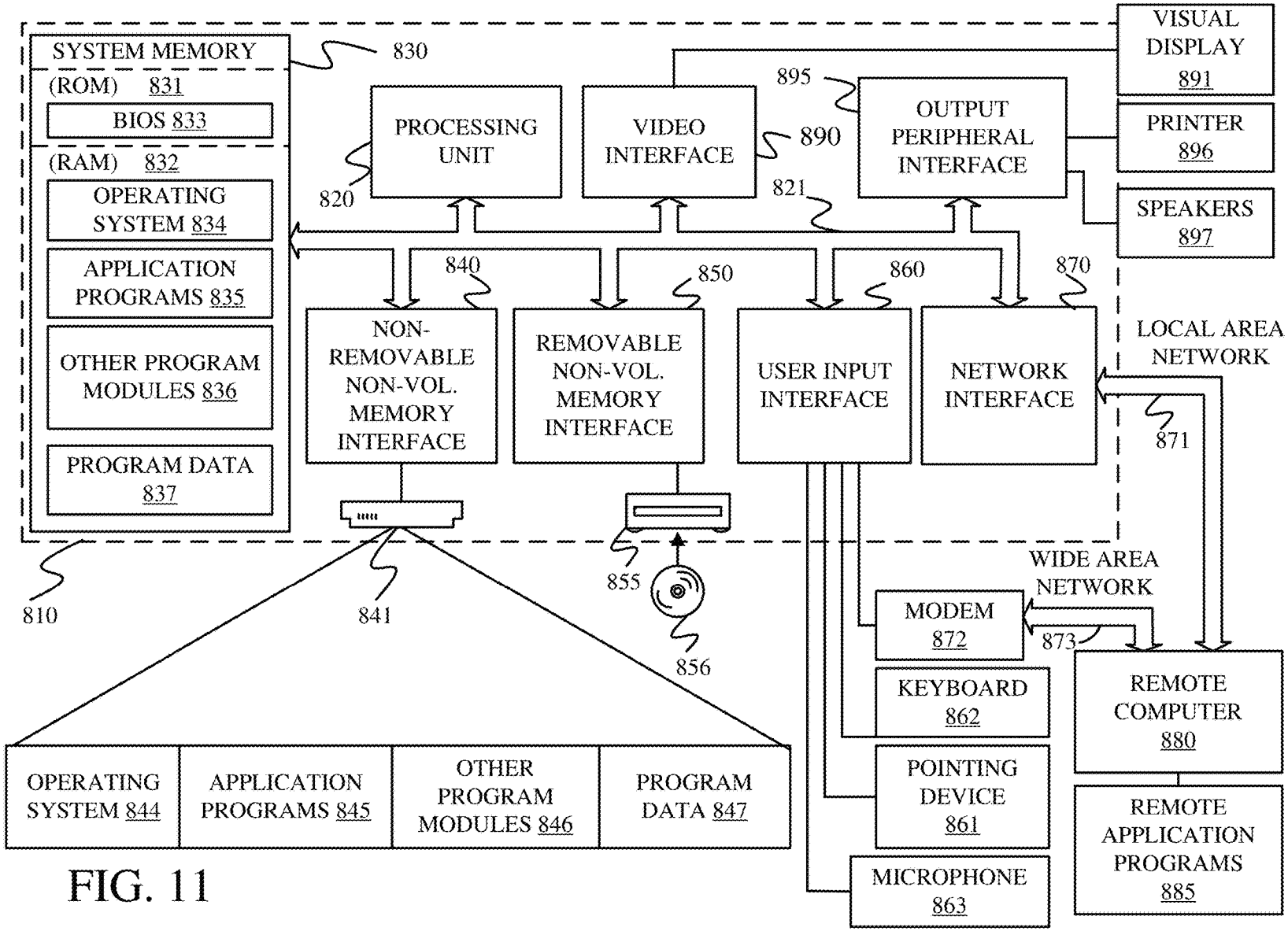
FIG. 11 is a block diagram of one example of a computing environment.

FIG. 11 is one example of a computing environment in which elements of previous FIGS., or parts of it, (for example) can be deployed. With reference to FIG. 11, an example system for implementing some embodiments includes a computing device in the form of a computer 810 programmed to operate as described above. Components of computer 810 may include, but are not limited to, a processing unit 820 (which can comprise processors or servers from previous FIGS.), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to previous FIGS. can be deployed in corresponding portions of FIG. 11.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 11 illustrates operating system 834, application programs 835, other program modules 836, and program data 837.

The computer 810 may also include other removable/non-removable volatile/nonvolatile computer storage media. By way of example only, FIG. 11 illustrates a hard disk drive 841 that reads from or writes to non-removable, nonvolatile magnetic media, an optical disk drive 855, and nonvolatile optical disk 856. The hard disk drive 841 is typically connected to the system bus 821 through a non-removable memory interface such as interface 840, and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 11, provide storage of computer readable instructions, data structures, program modules and other data for the computer 810. In FIG. 11, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a controller area network—CAN, local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 11 illustrates, for example, that remote application programs 885 can reside on remote computer 880.

It should also be noted that the different examples described herein can be combined in different ways. That is, parts of one or more examples can be combined with parts of one or more other examples. All of this is contemplated herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method of controlling a work machine, comprising:

detecting a rotary position of a first frame on the work machine, to which a dig component is attached, relative to a second frame to which a blade is attached;

detecting a position of the dig component;

identifying a position of the blade;

receiving a command input to actuate an actuator to move the dig component;

determining that the detected rotary position of the first frame on the work machine relative to the second frame satisfies a rotary position criterion;

based on the determination that the detected rotary position satisfies the rotary position criterion, generating a determination whether execution of the command input will move the dig component to within a threshold separation distance of the blade; and generating an action signal to control actuation of the actuator based on the determination.

2. The method of claim 1 wherein generating the action signal comprises:

controlling actuation of the actuator to limit movement of the dig component to maintain the threshold separation distance between the dig component and the blade.

3. The method of claim 1 wherein identifying the position of the blade comprises:

capturing an image of the blade with an optical sensor; and performing image processing on the image to identify the position of the blade.

4. The method of claim 1 wherein generating the action signal comprises:

if execution of the command input will move the dig component to within the threshold separation distance of the blade, generating an operator alert output.

5. A computer implemented method of controlling a work machine, comprising:

detecting a rotary position of a first frame on the work machine, to which a dig component is attached, relative to a second frame to which a blade is attached, the blade being movable relative to the second frame through a range of blade positions;

detecting a position of the dig component;

selecting a predefined blade position of the range of blade positions;

identifying a separation value based on the predefined blade position and the detected position of the dig component, the separation value being indicative of a distance and direction separating the dig component from the blade;

receiving a command input to actuate an actuator to move one of the dig component or the blade; and generating an action signal to control the work machine based on the command input, the rotary position, and the separation value.

6. The computer implemented method of claim 5 wherein generating the action signal comprises:

controlling actuation of the actuator based on the command input, the rotary position, and the separation value.

7. The computer implemented method of claim 6 wherein controlling actuation of the actuator comprises:

determining whether execution of the command input will reduce the separation value past a threshold separation distance; and if so, controlling actuation of the actuator to limit movement of the dig component or the blade to maintain the separation value at the threshold separation distance.

8. The computer implemented method of claim 7 wherein detecting the position of the dig component comprises detecting the position of the dig component with a dig component position sensor.

9. The computer implemented method of claim 5 wherein generating the action signal comprises:

determining whether execution of the command input will reduce the separation value past a threshold separation distance; and if so, generating an operator alert output.

10. The computer implemented method of claim 5 wherein identifying the separation value indicative of the distance and direction separating the dig component from the blade comprises:

detecting a location of the dig component on a vertical plane;

determining a location of the predefined position of the blade on the vertical plane; and calculating the separation value based on the location of the dig component on the vertical plane and the location of the blade on the vertical plane.

11. The computer implemented method of claim 5 wherein identifying the separation value indicative of the distance and direction separating the dig component from the blade comprises:

identifying the separation value as indicative of the distance and direction of separation between the blade and at least one of a boom, an arm, or an attachment on the work machine.

12. A work machine, comprising:

a first frame;

a house supported by the first frame;

a dig component attached to the first frame;

a first actuator configured to drive movement of the dig component relative to the first frame;

a second frame;

a blade connected to the second frame;

a rotary actuator configured to drive rotation of the first frame relative to the second frame;

a rotary position detector configured to detect a rotary position of the first frame relative to the second frame; and a collision avoidance system configured to:

identify a position of the dig component and a position of the blade;

receive a command input to actuate the first actuator to move the dig component; and determine that the detected rotary position of the first frame relative to the second frame satisfies a rotary position criterion;

based on the determination that the detected rotary position satisfies the rotary position criterion, generate a determination whether execution of the command input will move the dig component to within a threshold separation distance of the blade; and generate an action signal to control actuation of the first actuator to limit movement of the dig component to maintain the threshold separation distance between the dig component and the blade.

13. The work machine of claim 12 wherein the collision avoidance system is configured to determine that the detected rotary position satisfies the rotary position criterion based on a determination that the rotary position comprises one or more predefined rotary positions.

14. The work machine of claim 12 wherein the collision avoidance system comprises:

a position identifying system configured to identify the position of the dig component relative to the position of the blade.

15. The work machine of claim 14 wherein the position identifying system comprises:

a dig component position detector configured to detect the position of the dig component;

a second frame location system configured to identify a location of the second frame relative to the dig component; and a blade position identification system configured to identify the position of the blade relative to the second frame.

16. The work machine of claim 15 wherein the blade position identification system 19. comprises:

a camera configured to capture an image of the blade; and an image processor configured to process the image to identify the position of the blade.

17. The work machine of claim 12 wherein the collision avoidance system comprises:

an input command processor configured to determine whether execution of the command input will move the dig component to within a threshold separation distance of the blade; and an alert generator configured to generate an operator alert output.

18. The method of claim 1 wherein determining that the detected rotary position satisfies the rotary position criterion comprises determining that the rotary position comprises one or more predefined rotary positions.

19. The method of claim 18 wherein the one or more predefined rotary positions represent rotary positions for possible collision between the dig component and the blade.

20. The computer implemented method of claim 8, wherein the predefined blade position comprises a blade position in which a distance between the blade and the dig component is least.

* * * * *